US005238296A

United States Patent [19]

Paul

[11] Patent Number: 5,238,296

[45] Date of Patent: Aug. 24, 1993

[54] FOOT ROCKER

[76] Inventor: Gerald S. Paul, c/o Medreco, Inc., P.O. Box 320, Liberty, Ind. 47353

[21] Appl. No.: 814,486

[22] Filed: Dec. 30, 1991

[51] Int. Cl.[5] ..... A47C 16/00

[52] U.S. Cl. ..... 297/423.43; 297/423.26

[58] Field of Search ..... 297/438, 439, 423

[56] References Cited

U.S. PATENT DOCUMENTS

| | | | |
|---|---|---|---|
| 590,520 | 9/1897 | Harte | 297/439 X |
| 815,046 | 3/1906 | Sherman . | |
| 2,085,164 | 6/1937 | Mead | 297/439 |
| 2,281,119 | 4/1942 | Smith | 297/439 |
| 2,856,986 | 10/1958 | O'Leary | 297/439 |
| 2,912,046 | 11/1959 | Fuerst | 297/439 |
| 2,983,309 | 5/1961 | Brantl | 297/439 |
| 2,991,126 | 7/1961 | Deady | 297/439 |
| 3,554,600 | 1/1971 | Hennessey | 297/439 |
| 3,556,591 | 1/1971 | Smith | 297/439 |
| 3,563,605 | 2/1971 | Pinkas | 297/439 |
| 3,606,458 | 9/1971 | Attinger | 297/439 |
| 4,218,093 | 8/1980 | Gertz | 297/439 |
| 4,427,234 | 1/1984 | Peters | 297/439 |

FOREIGN PATENT DOCUMENTS

| | | | |
|---|---|---|---|
| 0030970 | 10/1926 | France | 297/439 |
| 0969002 | 12/1950 | France | 297/439 |

*Primary Examiner*—Kenneth J. Dorner
*Assistant Examiner*—Milton Nelson, Jr.
*Attorney, Agent, or Firm*—Biebel & French

[57] ABSTRACT

A footrest device is disclosed including a base portion adapted to rock on a lower surface thereof and a foot supporting upright portion adapted to support the feet of a person sitting in a rocking chair. The upright foot support portion includes a pivoted bolster pad and the device may be used in two modes of operation. The first mode of operation permits a person to rest his or her feet on the bolster pad with the pad in a substantially horizontal position. In the second mode of operation, the bolster pad is pivoted to a substantially vertical position such that a person may rest their feet on the base portion of the device.

8 Claims, 3 Drawing Sheets

FOOT ROCKER

BACKGROUND OF THE INVENTION

The present invention relates to a footrest and, more particularly, to a footrest for supporting a person's feet in an elevated position and which is capable of rocking motion such that the footrest may be used by a person sitting in a rocking chair.

Footrest devices for supporting the feet of a person sitting in a chair have been available for many years. For example, Sherman U.S. Pat. No. 815,046 discloses a footrest including a foot board which is pivotally mounted to a box-like receptacle forming a stationary base for the device such that a support member will move back and forth with the movement of a person's legs while the person is rocking in a rocking chair.

Mead U.S. Pat. No. 2,085,164 discloses a foot and leg rest including a rocking base and foot and leg support members supported on an X-shaped structure. The support members for the feet and legs are maintained in position in stationary relationship to the rocking base portion of the device.

Finally, U.S. Pat. Nos. 2,856,986 and 3,563,605 disclose rocking footrest and leg supports which are provided with rocking bases and which include leg and foot supports which are pivotally mounted relative to the base.

While the prior art discloses devices for moving in a rocking motion in response to a biasing force applied by a person sitting in a rocking chair such that a person may comfortably rest their feet while rocking in a chair, and the prior art discloses devices for supporting the feet and back of the legs of a person while sitting in a chair, none of the devices thus far developed have provided a dual purpose leg and foot support device which is adapted to support a person's feet with the person's legs extended straight out in a horizontal position and also support the back of a person's legs and the person's feet with the person's legs bent at the knees.

SUMMARY OF THE INVENTION

The present invention provides a footrest device which includes a base portion having a rocker portion defining opposing lateral sides of the base portion. The rocker portion includes oppositely extending front and rear portions formed symmetrically about the center of the rocker portion.

The rocker portion includes lower edges which are directed upwardly from the center of the rocker portion toward the opposing ends of the front and rear portions. In addition, the rocker portion includes a substantially planar upper surface thereof extending in a horizontal plane.

The base portion further includes front and rear substantially planar footrest members having lateral edges which are attached to the rocker portion. The footrest portions define an upper surface for the base portion and form a platform oriented parallel to the upper surface of the rocker portion for supporting a person's feet.

A pair of elongated side portions extend vertically upwardly from the lateral sides of the base portion and are attached to the base portion centrally of the rocker portion. A substantially planar heel support extends vertically upwardly from the base portion and is located between the side portions. The heel support is oriented perpendicularly relative to the footrest members such that the heels of a person may rest against the heel support as their feet rest against a footrest member.

The side portions also support a bolster pad member located above the heel support. The bolster member is pivotally mounted to the side portions and is provided to support the feet of a person sitting in a chair.

The footrest device of the present invention differs from the prior art in that the bolster member may be oriented in a horizontal position to support the feet or legs of a person sitting in a rocking chair with the person's knees being substantially straight such that a person may rock in a rocking chair with the rocker portion rocking back and forth to permit the bolster pad to move in a back and forth movement in response to the movement of the person sitting in the rocking chair.

In an alternative use of the footrest device, the bolster pad may be pivoted through 90° such that it is substantially aligned in a plane with the heel support. In this position, a person may rest his or her feet on the foot support with the back of their heels engaged on the heel support and the bolster pad engaged with the back of their legs just below the knees, and the person's legs would be bent at the knees.

Thus, the present invention provides a comfortable support for a person's feet and legs wherein the person may choose between two positions for their legs.

Other objects and advantages of the invention will be apparent from the following description, the accompanying drawings, and the appended claims.

DETAILED DESCRIPTION OF THE PREFERRED EMBODIMENT

Figure 1:
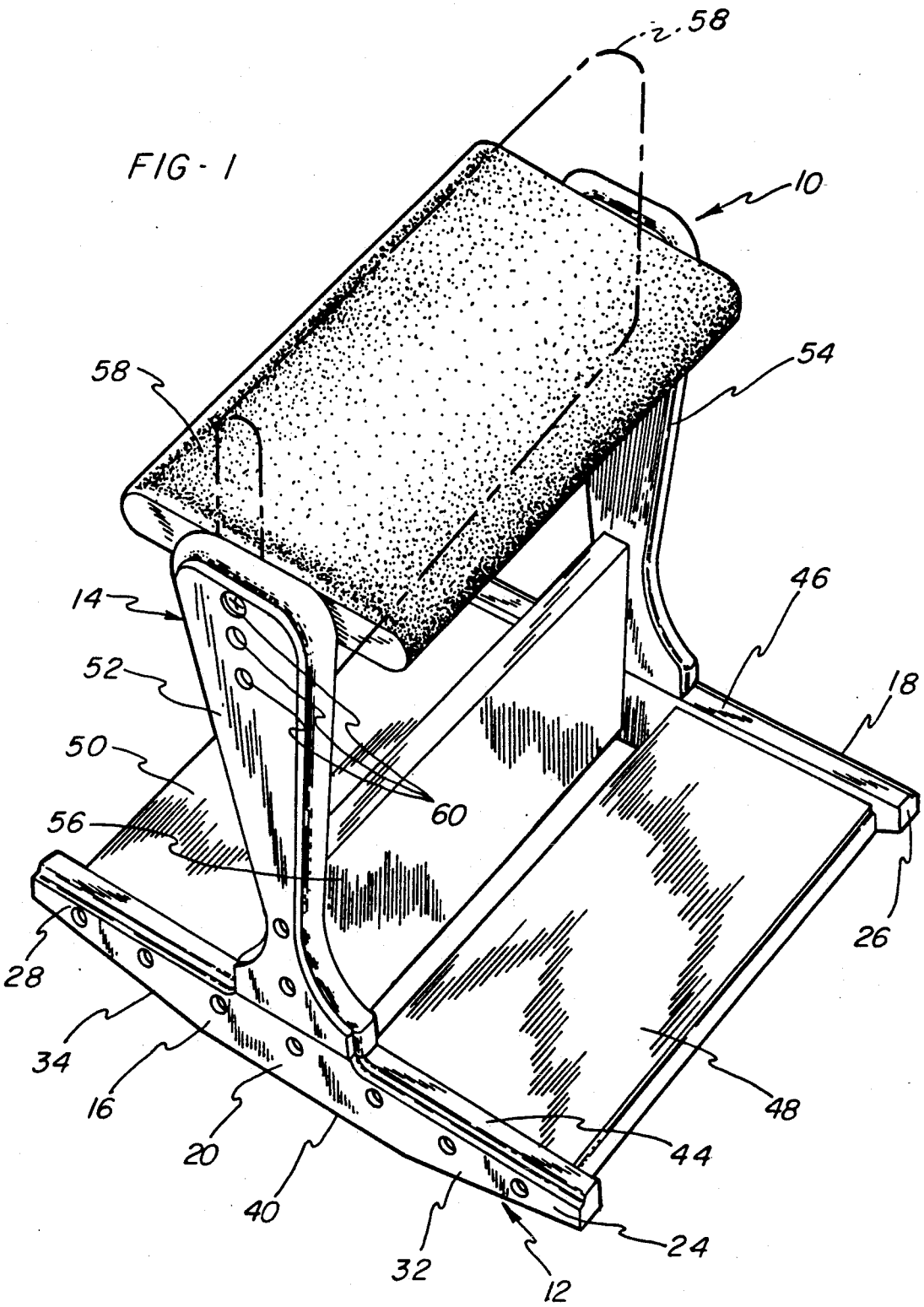
FIG. 1 is a right front perspective view of the footrest device of the present invention.

Referring to FIG. 1, the footrest device of the present invention, designated generally as 10, includes a base portion 12 and a vertical foot support structure 14 attached to the top of the base portion 12.

The base portion 12 includes first and second rocker members 16, 18 which are formed identical with each other. Each of the rocker members 16, 18 include a central portion 20, 22 (see FIGS. 2 and 3) and front and rear portions 24, 26 and 28, 30, respectively, formed symmetrically about the central portions 20, 22. In addition, the first rocker member 16 includes lower edges 32, 34 extending upwardly from the central portion 20 toward the forwardmost and rearwardmost edges of the front and rear portions 24, 28. Similarly, the rocker member 18 includes lower edges 36, 38 extending upwardly from the central portion 22 toward the forwardmost and rearwardmost edges of the front and rear portions 26, 30, respectively.

It should be noted that although the rocker members 16, 18 are shown with a somewhat flattened central portion lower edge 40, 42, respectively, the lower edge portion of the rocker members 16, 18 may be formed with a smooth arcuate shape extending from the forwardmost to the rearwardmost edges of the rocker members 16, 18.

The rocker members 16, 18 each include an upper substantially planar edge surface 44, 46, respectively, and front and rear substantially planar footrest members 48, 50 are provided having lateral edges attached to the rocker members 16, 18 wherein the footrest members 48, 50 are located adjacent to and extend parallel to the upper edges 44, 46. The footrest members 48, 50 define an upper surface for the base portion 16. Thus, the lateral edges of the base portion 12 are defined by the rocker members 16, 18, the lower portion of the base portion 12 is defined by the lower edges 32, 34, 40 and 36, 38, 42, and the upper portion of the base 12 is defined by the upper surfaces 44, 46 and the footrest members 48, 50.

The vertical foot support structure 14 of the footrest device 10 includes first and second elongated upright members 52, 54 which are attached to the upper edges of the central portion of respective rocker members 16, 18 to define a substantially T-shaped structure for the device 10. A substantially planar heel support plate 56 extends upwardly perpendicular to the footrest members 48, 50 and includes lateral edges which are attached to the first and second upright members 52, 54. The plate 56 is located closely adjacent to the footrest members 48, 50 such that the back of a person's heels may engage the plate 56 when the person's feet are resting on either footrest member 48, 50, as will be described further below.

The foot support structure 14 further includes a bolster pad member 58 which is mounted for pivotal movement between the upright members 52, 54. In the preferred embodiment, each of the upright members 52, 54 is provided with a plurality of apertures 60 and a rod member is preferably extended through the center of the bolster pad 58 and passes through one of the apertures 60 in each of the upright members 52, 54 to permit pivotal movement of the bolster pad 58. Alternatively, a fastener may be extended through one of the apertures 60 in each of the members 52, 4 to engage a lateral end of the bolster pad 58. Thus, the bolster pad 58 may be adjusted to a plurality of vertical positions spaced relative to the heel support plate 56 and the base portion 12. As is illustrated by the bolster pad position shown in phantom lines in FIG. 1, the bolster pad 58 may be pivoted through at least 90° of movement and is preferably pivotable through 360°.

Figure 2:
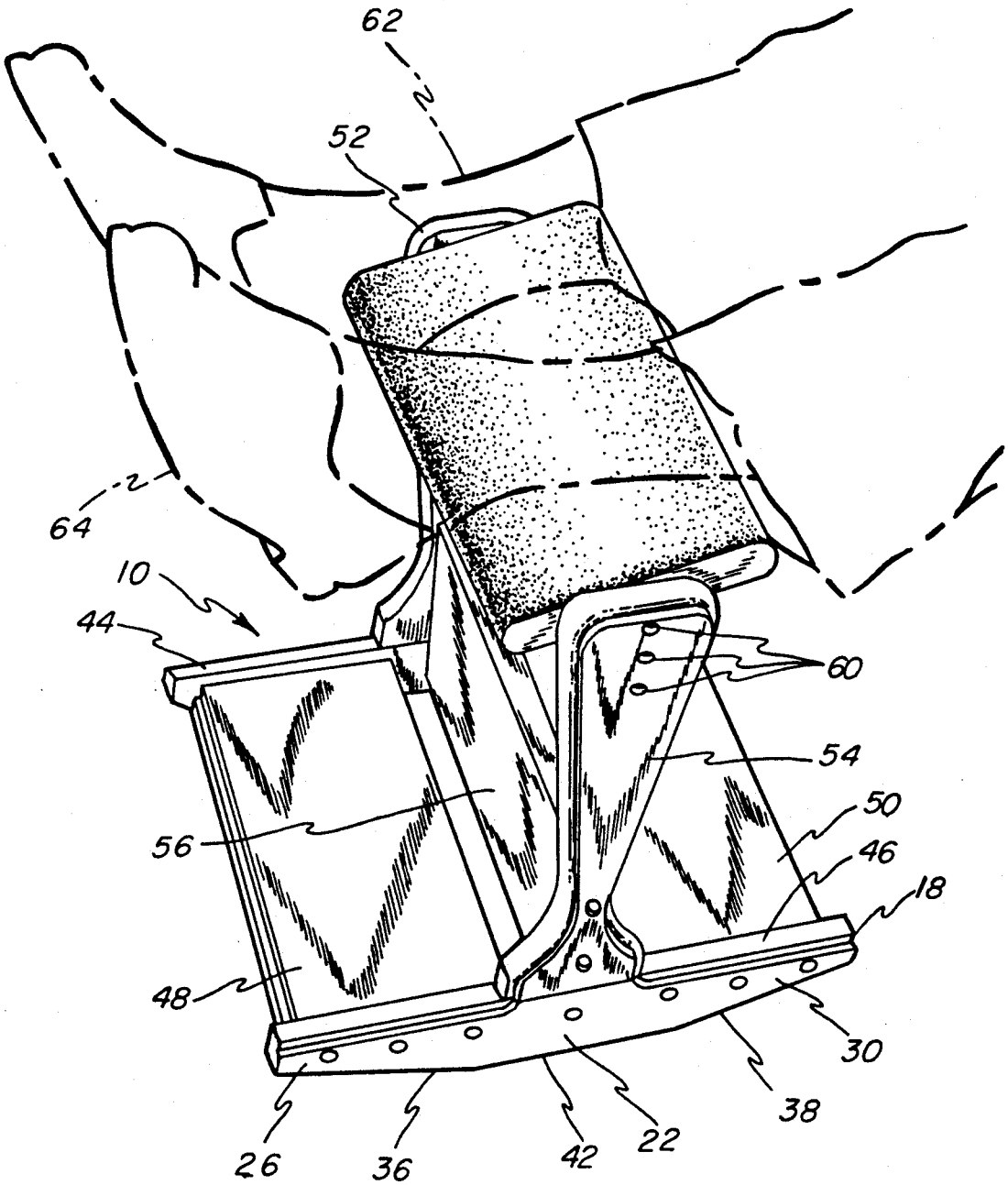
FIG. 2 is a left front perspective view showing the footrest in use on a first mode of operation.

Referring now to FIG. 2, the bolster pad is shown in use in a first mode of operation wherein the feet 64 of a person may be supported adjacent to the upper end of the upright members 52, 54. In this mode of operation, the person's legs 62 will be substantially straight, or unbent at the knees and the device 10 may rock back and forth as the person's legs 62 move back and forth with the rocking of a rocking chair.

Figure 3:
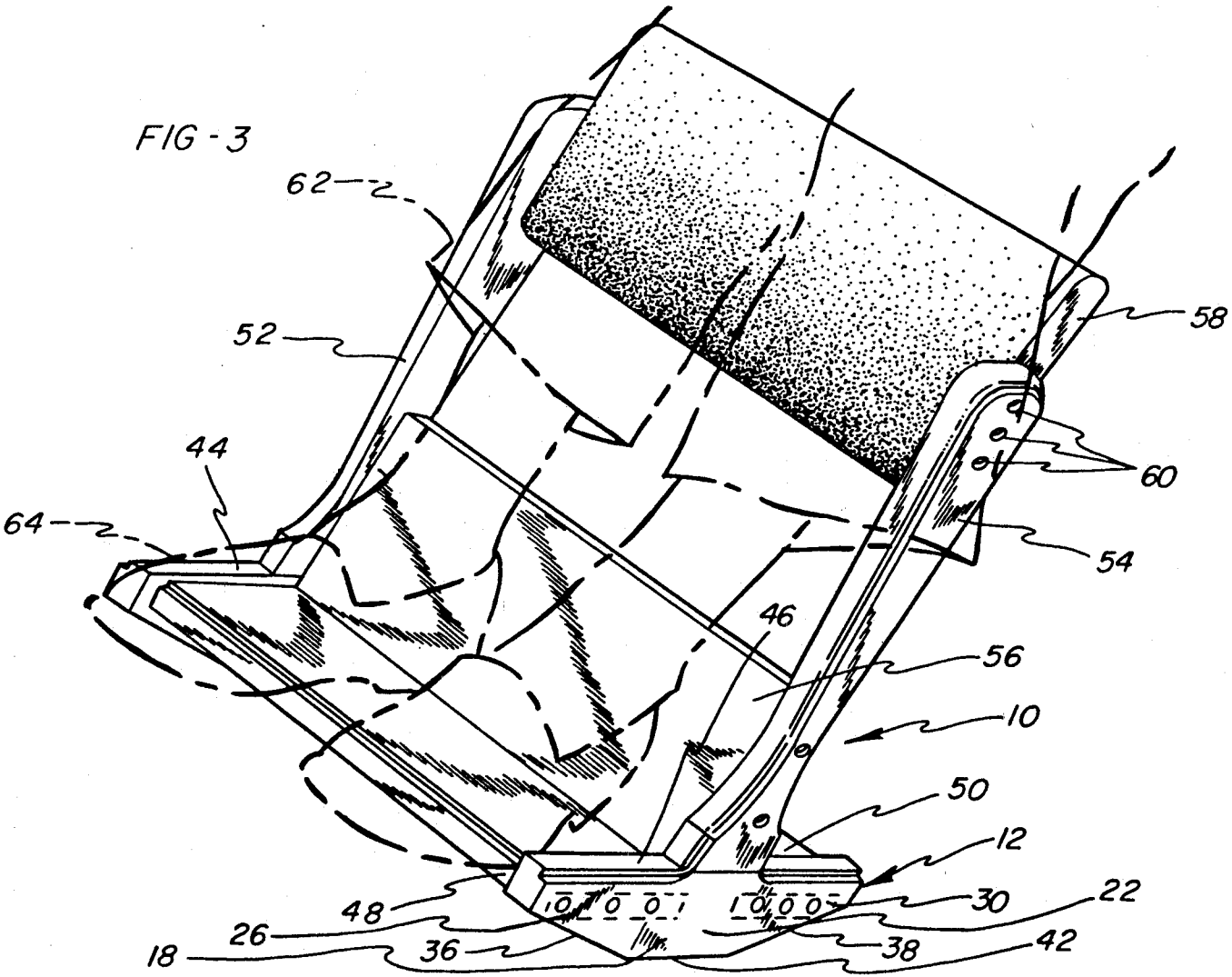
FIG. 3 is a left front perspective view showing the footrest in use in a second mode of operation.

FIG. 3 illustrates the device 10 in use in a second mode of operation wherein a person's feet 64 are resting on the footrest member 48 and the back of the person's heels are resting against the heel support plate 56. In this mode of operation, the bolster pad 58 is pivoted to a position substantially parallel to the plane of the heel support plate 56 and engages the back portion of the person's legs 62 which are somewhat bent at the knees. In addition, it should be noted that in this mode of operation the device 10 is typically pivoted backward such that it rests on one of the extreme lower edges 34, 38 of the base portion 12.

The mode of operation shown in FIG. 3 is also adapted to be used in combination with a rocking chair such that as a person rocks forward in the chair, the front portion 24, 26 of the base 12 will pivot downwardly slightly and the upright members 52, 54 will pivot forwardly in a comfortable rolling action such that the device 10 continuously provides support for the feet and legs of the person.

Thus, it should be apparent that the present invention provides a footrest device which includes a bolster pad mounted for pivotal movement whereby the bolster pad may automatically adjust to varying angles of a person's legs relative to the device. In addition, the device provides a footrest which may be used in two different modes of operation including a first mode wherein the person's feet are supported adjacent to the upper portion of the upright members such that a large arc of forward and rearward movement may be provided at the bolster pad while the base requires only a small degree of rolling movement to accommodate the motion of the person's feet.

In the second mode of operation for the device, the person's feet are supported adjacent to the lower end of the upright members and the device substantially located in a rearwardly pivoted position which permits the device to rock forwardly as a person rocks in a rocking chair. However, a substantial portion of the forward movement produced by the person rocking forward will be accommodated by bending of the person's knees such that in this mode of operation only a small pivotal movement of the device occurs. It should be noted that although the present invention is described with reference to use in combination with a rocking chair, this footrest device may also be used by persons sitting in any type of chair and the footrest provides a variety of positions for supporting the person's legs in a comfortable position regardless of the chair being used.

Further, it should be apparent that by forming the front and rear portions of the device symmetrically, either portion may be used to support a person's feet in the second mode of operation.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. A footrest device comprising:

a base portion;

a rocker portion defining opposing lateral sides for said base portion, said rocker portion including oppositely extending front and rear portions formed symmetrically about a central rocker portion and said rocker portion defining lower edges directed upwardly from said central rocker portion toward opposing ends defined by said front and rear portions;

side portions extending upwardly from said lateral sides of said base portion;

a substantially planar heel support located between said side portions and extending upwardly from said base portion;

front and rear substantially planar footrest members extending between said lateral sides and forwardly and rearwardly, respectively, from said heel support, said front and rear footrest members extending substantially perpendicular to said heel support;

a bolster member located above said heel support and extending between said side portions for engaging the legs of a person; and wherein said bolster member is located to support the legs of a person with the feet of the person engaging said heel support and either said front footrest member or said rear footrest member.

2. The footrest of claim 1 wherein said bolster member is planar and including means defining a pivot axis for said bolster member passing through each of said side portions and said bolster member whereby said bolster member is pivotable through approximately 180 degrees.

3. A footrest device comprising:

a base portion;

first and second rocker portions defining opposing lateral sides for said base portion, each of said rocker portions including oppositely extending front and rear portions formed symmetrically about a central rocker portion and each said rocker portion defining a substantially planer upper portion and lower edges directed upwardly from said central rocker portion toward opposing ends defined by said front and rear portions;

front and rear substantially planar footrest members including lateral edges attached to said first and second rocker portions and defining an upper surface for said base portion, said footrest members extending substantially parallel to said upper surfaces of said rocker portions;

first and second elongated upright members having upper and lower ends, said upright members being attached to and extending upwardly from respective central rocker portions of said first and second rocker portions;

a substantially planar heel support extending upwardly perpendicular to said footrest members and including lateral edges attached to said first and second upright members;

means defining a plurality of vertically spaced apertures in each of said first and second upright members;

a substantially planar bolster pad extending between said first and second upright members;

pin means extending through one of said apertures in each of said upright members and engaging said bolster pad such that said bolster pad may pivot through an angle of at least 90 degrees; and wherein said bolster pad may be pivoted to a position oriented substantially parallel to said footrest members to support the legs of a person with the feet of the person adjacent to said upright member upper ends and said pad may be pivoted to a position oriented substantially perpendicular to said footrest members to support the legs of a person with the feet of the person engaging said heel support and one of said footrest members adjacent to said upright member lower ends.

4. A footrest device comprising:

a base portion;

a rocker portion defining opposing lateral sides for said base portion, said rocker portion including oppositely extending front and rear portions formed symmetrically about a central rocker portion and said rocker portion defining lower edges directed upwardly from said central rocker portion toward opposing end defined by said front and rear portions;

a substantially planar footrest portion defining an upper surface for said base portion;

side portions extending upwardly from said lateral sides of said base portion;

a substantially planar heel support located between said side portions and extending upwardly from said base portion perpendicular to said footrest portion;

a planar bolster member located on upper ends of said side portions above said heel support and extending between said side portions for engaging the legs of a person;

pivot means attaching said bolster member to said side portions whereby said bolster member is supported for pivotal movement through at least 180° about a pivot axis; and wherein said bolster member may be pivoted about said pivot axis to a position oriented substantially parallel to said footrest portion to support the legs of a person with the feet of the person adjacent to said upper ends of said side portions and said bolster member may be pivoted about said pivot axis to a position oriented substantially perpendicular to said footrest portion to support the legs of a person with the feet of the person engaging said heel support and said footrest portion adjacent to lower ends of said side portions.

5. The footrest of claim 1, wherein said bolster member is located in spaced relation to said heel support.

6. The footrest of claim 4, including means for adjustably positioning the location of said bolster member at preselected vertical distances from said heel support.

7. The footrest of claim 1, wherein said side portions include first and second elongated members extending upwardly from said central rocker portion, and said rocker portion and said side portions form a T-shaped structure.

8. The footrest of claim 1, wherein said rocker portion includes first and second laterally spaced members and said footrest portion includes lateral edges attached to said first and second laterally spaced members.

* * * * *